US005299425A

United States Patent [19]

Hingst

[11] Patent Number: 5,299,425

[45] Date of Patent: Apr. 5, 1994

[54] COOLING APPARATUS

[75] Inventor: Uwe Hingst, Oberteuringen, Fed. Rep. of Germany

[73] Assignee: Bodenseewerk Gerätetechnik GmbH, Bodensee, Fed. Rep. of Germany

[21] Appl. No.: 964,804

[22] Filed: Oct. 22, 1992

[30] Foreign Application Priority Data

Oct. 30, 1991 [DE] Fed. Rep. of Germany ..... 4135764

[51] Int. Cl.[5] ..... F25B 19/02

[52] U.S. Cl. ..... 62/51.1; 62/51.2

[58] Field of Search ..... 62/51.1, 51.2

[56] References Cited

U.S. PATENT DOCUMENTS

| | | | |
|---|---|---|---|
| 3,256,712 | 6/1966 | Makowski | 62/51.2 |
| 3,372,556 | 3/1968 | Waldman | 62/45 |
| 3,782,129 | 1/1974 | Peterson | 62/51.2 |
| 4,126,017 | 11/1978 | Bytniewski et al. | 62/51.2 |
| 4,781,033 | 11/1988 | Steyert et al. | 62/51.2 |
| 4,819,451 | 4/1989 | Hingst | 62/51.2 |
| 4,838,041 | 6/1989 | Bellows et al. | 62/51.2 |
| 5,077,465 | 12/1991 | Wagner et al. | 250/203.1 |
| 5,077,979 | 1/1992 | Skertic et al. | 62/51.2 |
| 5,150,579 | 9/1992 | Hingst | 62/51.2 |

FOREIGN PATENT DOCUMENTS

| | | | |
|---|---|---|---|
| 0234644A1 | 9/1987 | European Pat. Off. . | |
| 0271989A1 | 6/1988 | European Pat. Off. . | |
| 1502715 | 7/1969 | Fed. Rep. of Germany . | |
| 1501715 | 10/1969 | Fed. Rep. of Germany . | |
| 1501106 | 1/1970 | Fed. Rep. of Germany . | |
| 3337194A1 | 4/1985 | Fed. Rep. of Germany . | |
| 3337195A1 | 4/1985 | Fed. Rep. of Germany . | |
| 3642683A1 | 6/1988 | Fed. Rep. of Germany . | |
| 3925942A1 | 2/1991 | Fed. Rep. of Germany . | |
| 3941314A1 | 6/1991 | Fed. Rep. of Germany . | |
| 567039 | 7/1977 | U.S.S.R. | 62/51.2 |
| 658368 | 4/1979 | U.S.S.R. | 62/51.2 |
| 756148 | 8/1980 | U.S.S.R. | 62/51.2 |
| 1330837 | 9/1873 | United Kingdom | 62/51.2 |
| 1238911 | 7/1971 | United Kingdom . | |
| 2119071A1 | 11/1983 | United Kingdom . | |
| 2133868 | 8/1984 | United Kingdom | 62/51.2 |

*Primary Examiner*—Henry A. Bennet
*Assistant Examiner*—Christopher B. Kilner
*Attorney, Agent, or Firm*—Lowe, Price, LeBlanc & Becker

[57] ABSTRACT

In a cooling apparatus for cooling an object by means of expanding a pressurized gas which is precooled below its inversion temperature, the pressurized, precooled gas is passed through a depressurization outlet and thereby expanded in a manner such that a gas jet exits from the depressurization outlet and is directed towards a surface of the object to be cooled. This surface has a central impingement area which is impinged upon by the gas jet and which is surrounded by a plurality of spiral-shaped outwardly extending ribs. The heat transfer is thereby improved. The gas, which is in the saturated condition, forms a vortex and, as a result, droplets are separated from the gas. This enables utilizing the heat of vaporization of such droplets.

9 Claims, 5 Drawing Sheets

COOLING APPARATUS

BACKGROUND OF THE INVENTION

The present invention relates to a new and improved construction of a cooling apparatus for cooling an object by means of expanding a pressurized gas which is precooled below its inversion temperature; the pressurized, precooled gas is passed through a depressurization outlet and thereby expanded in a manner such that a gas jet exits from the depressurization outlet and is directed towards a surface of the object to be cooled.

In a cooling apparatus such as known, for example, from British Patent No. 1,238,911, published Jul. 14, 1971, cooling is achieved by means of a pressurized gas which is expanded or depressurized by being passed through a nozzle For this purpose, the gas must have a temperature below its inversion temperature prior to expansion or depressurization. In order to accomplish this, the cooling apparatus according to British Patent No. 1,238,911 is equipped with two coolers. In a first one of the two coolers a first gas is conducted in the gaseous state from a source of pressurized gas along a first path of a countercurrent heat exchanger, expanded or depressurized through the nozzle and returned along a second path of the heat exchanger in countercurrent fashion As a result, the forward flowing pressurized gas is cooled. The second one of the two coolers causes precooling of the first gas prior to arrival at the countercurrent heat exchanger of the first cooler In this arrangement, the second cooler receives a pressurized liquid which is sprayed into a chamber through a nozzle. During this operation, the liquid evaporates whereby the cooling action of the second cooler is provided The first cooler of this arrangement serves to cool an object in the form of an infrared detector.

German Published Patent Application No. 3,642,683, published Jun. 16, 1988, and cognate with U.S. Pat. No. 4,819,451, granted Apr. 11, 1989, describes a cryostat for cooling an infrared detector and which cryostat is based on the Joule-Thomson effect A countercurrent heat exchanger includes a forward or infeed conduit and is placed in a Dewar vessel. The forward or infeed conduit terminates in an expansion or depressurization nozzle. The infrared detector is placed at an end wall inside the Dewar vessel. A heat insulating layer is arranged between the Dewar vessel and a base in order to reduce the heat load. In order to improve the cooling power of the Joule-Thomson process achievable at a predetermined mass flow of the pressurized gas, an inlet end of the forward or infeed conduit is cooled by means of Peltier elements.

German Published Patent Application No. 1,502,715, published Oct. 30, 1969, shows an apparatus for liquifying a gas. The apparatus includes two expansion coolers; a first one of the two expansion coolers is operated using hydrogen whereas a second one of the two expansion coolers is operated using air or nitrogen. Both the two expansion coolers are constructed as Joule-Thomson coolers, i.e. contain a countercurrent heat exchanger in which the respective expanded or depressurized and cooled gas enters into heat exchange with the forward flowing or infed gas. The liquid nitrogen or liquid air which is obtained by means of the second Joule-Thomson cooler serves for precooling the hydrogen present in the first Joule-Thomson cooler. The hydrogen is thereby cooled below its inversion temperature. However, the nitrogen can be cooled by means of the respective Joule-Thomson cooler only down to the boiling point of nitrogen.

A similar arrangement is shown in German Published Patent Application No. 1,501,106, published on Jan. 8, 1970.

European Published Patent Application No. 0,271,989, published on Jun. 22, 1988, describes using, in a conventional single-stage Joule-Thomson cooler, a coolant comprising a mixture of nitrogen, argon or neon and methane, ethane or propane with the addition of combustion inhibiting materials like bromotrifluoromethane.

German Published Patent Applications Nos. 3,337,194, published on Apr. 25, 1985, and 3,337,195, published on Apr. 25, 1985, British Published Patent Application No. 2,119,071, published on Nov. 9, 1983, and European Published Patent Application No. 0,234,644, published on Sep. 2, 1987, illustrate the use of single-stage Joule-Thomson coolers for cooling electronic or opto-electronic components.

With respect to gyro-stabilized seekers including image resolving detectors, German Published Patent Application No. 3,925,942, published Feb. 14, 1991, and cognate with U.S. Pat. No. 5,077,465, granted Dec. 31, 1991, suggests arranging the seeker at a carrier which is aligned to the gyro rotor axis and thus to the optical axis of the imaging optical system so that, even in the case of "squinting" of the seeker, the plane of the planar detector constantly extends perpendicular to this optical axis. In this arrangement the problem exists of cooling the detector. In the Joule-Thomson coolers which are usually employed for cooling detectors, there is provided a countercurrent heat exchanger through which the expanded or depressurized gas is returned whereby the inflowing gas is precooled by the gas return flow. The expanded or depressurized gas should be utilized as completely as possible for the precooling operation. Losses of gas and heat must be avoided. This can be achieved when the detector is fixedly arranged in the Dewar vessel Problems, however, occur when the detector is mounted at a movable carrier.

German Published Patent Application No. 3,941,314, published on Jun. 20, 1991, and cognate with U.S. Pat. No. 5,150,579, granted Sep. 29, 1992, describes a cooling apparatus for cooling a pivotable detector using a first cooler which comprises an expansion or depressurization nozzle. Pressurized argon which has been precooled below its inversion temperature, is expanded or depressurized with cooling by passing the same through the expansion or depressurization nozzle. The argon precooling is effected by means of a second cooler which is operated using methane The second cooler constitutes a Joule-Thomson cooler including an expansion or depressurization outlet through which the pressurized methane is expanded or depressurized with cooling. A heat exchanger precedes the expansion or depressurization outlet and serves for precooling the infed methane by the cooled, expanded or depressurized methane. The first cooler, however, constitutes an expansion cooler including an expansion or depressurization outlet preceded by a heat exchanger in which the pressurized argon is in heat exchange only with the expanded and cooled methane The argon which issues from the expansion or depressurization outlet of the first cooler, is expanded or depressurized and cooled down to its boiling point and directed in the form of a jet towards the object to be cooled.

SUMMARY OF THE INVENTION

Therefore, with the foregoing in mind, it is a primary object of the present invention to provide a new and improved construction of a cooling apparatus which is not afflicted with the drawbacks and limitations of the prior art constructions.

Another and more specific object of the present invention is directed to the provision of a cooling apparatus of the initially mentioned type and which cooling apparatus is distinguished by a markedly improved cooling efficiency.

Now in order to implement these and still further objects of the invention, which will become more readily apparent as the description proceeds, the cooling apparatus of the present development is manifested by the features that, among other things, the surface contains a central impingement area which is impinged upon by the jet of cooled gas and surrounded by a plurality of spiral-shaped outwardly extending ribs or webs.

The aforementioned ribs or webs act in a two-fold manner. In one aspect, the heat transfer is improved between the expanded or depressurized gas and the surface impinged thereby. According to a further aspect, the aerosol, i.e. the mixture of gas and droplets of condensed gas, which impinges upon the impingement area of the surface, is made to rotate during its radial flow away from the surface whereby a cyclone- or vortex-type structure is formed As a consequence, the droplets are separated from the gas. The heavier droplets tend to flow towards the exterior whereas the gas flows off to the interior. The droplets may be collected and subsequently evaporate whereby still more heat is withdrawn from the object due to the required heat of evaporation. In the aforedescribed arrangement according to German Published Patent Application No. 3,941,314 the major portion of the droplets in the aerosol are entrained in the gas flow and remain ineffective for cooling the object.

It is an advantage in the inventive construction if a shell or jacket is attached to the object to be cooled. This shell or jacket defines a chamber in front of the aforementioned surface of the object and this chamber is provided with a central opening located opposite to the impingement area. A high-pressure line or conduit constituting the expansion or depressurization nozzle, protrudes through this opening. The high-pressure line or conduit may be surrounded by a heat insulating jacket. The opening may be surrounded by a collar which is concentrically disposed with respect to the highpressure line or conduit and a gas exit opening is defined between the collar and the high-pressure line or conduit The surface to be cooled may constitute a substantially planar surface. In such event, the opening may be formed in a wall extending substantially parallel to such planar surface and this wall bounds the aforementioned chamber conjointly with the planar surface to be cooled and the shell or jacket Secantially disposed guide surfaces or baffles may be provided on the interior side of the wall and protrude inwardly from the jacket; such guide surfaces extend along part of the spacing between the surface to be cooled and the wall.

In a preferred use of the inventive cooling apparatus the surface to be cooled is formed by the rear side of a substrate supporting an infrared detector to be cooled and which infrared detector is present in a seeker. The shell or jacket extends beyond the substrate on the side of the detector and defines a cooled stop or diaphragm associated with the path of rays defined in the seeker.

Similar to the cooling apparatus according to the aforementioned German Published Patent Application No. 3,941,314, the object may be pivotable relative to the expansion or depressurization outlet. Also, the gas of the jet directed towards the surface of the carrier for the object to be cooled, may be precooled by means of a Joule-Thomson cooler employing a gas which is different from methane; such Joule-Thomson cooler may comprise an expansion or depressurization outlet by means of which the pressurized second gas is expanded or depressurized with cooling, and a countercurrent heat exchanger which precedes the expansion or depressurization outlet for precooling the infed second gas by means of the cooled, expanded or depressurized second gas.

BRIEF DESCRIPTION OF THE DRAWINGS

The invention will be better understood and objects other than those set forth above, will become apparent when consideration is given to the following detailed description thereof Such description makes reference to the annexed drawings wherein the same or analogous components are designated by the same reference characters and wherein.

DETAILED DESCRIPTION OF THE PREFERRED EMBODIMENTS

Figure 1:
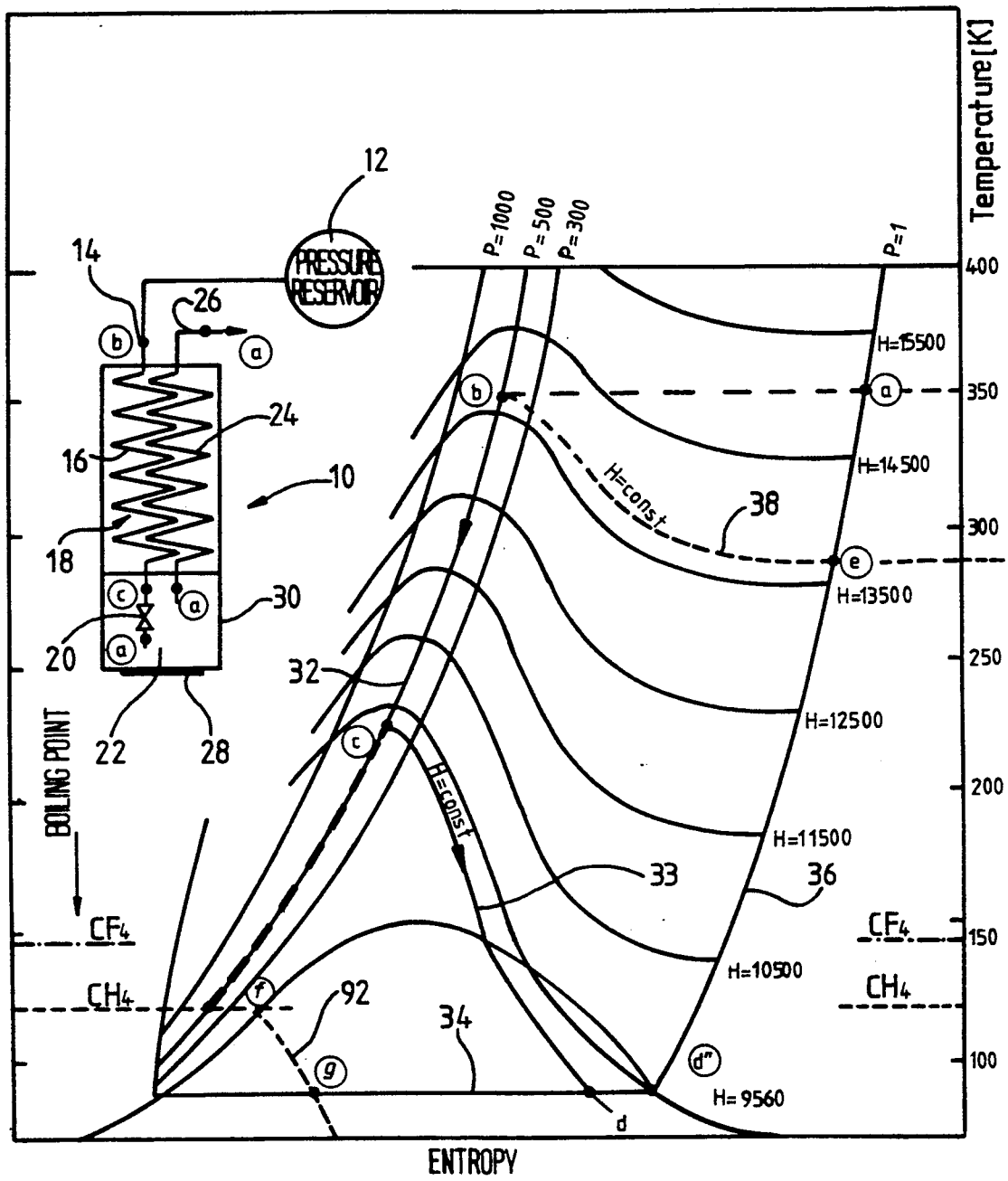
FIG. 1 is a schematic illustration of a conventional Joule-Thomson cooler shown in conjunction with a temperature-entropy diagram of argon for explaining the mode of action of such cooler.

Describing now the drawings, it is to be understood that only enough of the construction of the cooling apparatus has been shown as needed for those skilled in the art to readily understand the underlying principles and concepts of the present development, while simplifying the showing of the drawings. Turning attention now to FIG. 1 of the drawings, there is schematically shown therein a conventional JouleThomson cooler 10. Pressurized gas like, for example, argon flows from a source of pressurized gas such as a pressure cylinder 12 via an inlet 14 to the forward or infeed flow path 16 of a countercurrent heat exchanger 18. The pressurized gas issues from a nozzle or jet 20 into an expansion or depressurization chamber 22 whereby the gas is cooled. From the expansion or depressurization chamber 22, the expanded or depressurized and cooled gas flows back through a return flow path 24 of the countercurrent heat exchanger 18 and exits at an outlet 26. The inflowing or infed pressurized gas is precooled by the gas flowing back through the return flow path. An infrared detector designated by reference numeral 28 is intended to be cooled by means of the Joule-Thomson cooler 10.

The infrared detector 28 is placed at the interior wall 30 of a conventional Dewar vessel which is not illustrated and which surrounds the Joule-Thomson cooler 10.

The operation can be explained with reference to the temperature-entropy diagram shown in FIG. 1. In the diagram, the states or conditions prevailing at various locations of the Joule-Thomson cooler 10 are marked by reference characters "a" to "g". The associated locations in the schematic illustration of the Joule-Thomson cooler 10 have been correspondingly marked.

At the inlet 14 the pressurized gas has a temperature of about 350 K at a pressure of about 500 bar. This state or condition is marked "b" in the temperature-entropy diagram of Figure Along the forward or infeed flow path 16 of the countercurrent heat exchanger 18 the pressure remains essentially constant, however, the temperature drops due to precooling by means of the return gas flow. The state or condition thus changes along a curve 32 of constant pressure in a direction towards a state or condition marked "c" which prevails spatially immediately upstream of the nozzle or set 20. At the nozzle or jet 20, the gas is expanded or depressurized. The state or condition, as shown in the diagram, thus changes along a curve 33 of constant enthalpy to the state or condition marked "d". This point is located on the straight line 34 associated with the saturated state or condition. The gas thus is partially condensed so that there exists a mixture of gas and vapor. The temperature remains essentially constant.

The gas enters the return flow path 24 of the countercurrent heat exchanger 18 in the state or condition which is marked "d". Along the return flow path 24, the expanded or depressurized gas is reheated due to heat exchange with the pressurized gas in the forward or infeed flow path 16. This reheating process runs at substantially atmospheric pressure, i.e. at P=1 bar Consequently, the state or condition changes along curve 36 of constant pressure to the state or condition marked "a". At this point, the ambient temperature of about 350 K prevails.

The cooling efficiency is given by the enthalpy difference between the states or conditions marked "a" and "b". The enthalpy in the state or condition marked "b" is substantially equal to that of the state or condition marked "e". The point marked "e" is the intersection point of the constant pressure curve 36 and the constant enthalpy curve 38.

In comparison with the enthalpies which are exchanged in the countercurrent heat exchanger 18, the enthalpy difference between the states or conditions marked "a" and "e" is relatively small.

Figure 2:
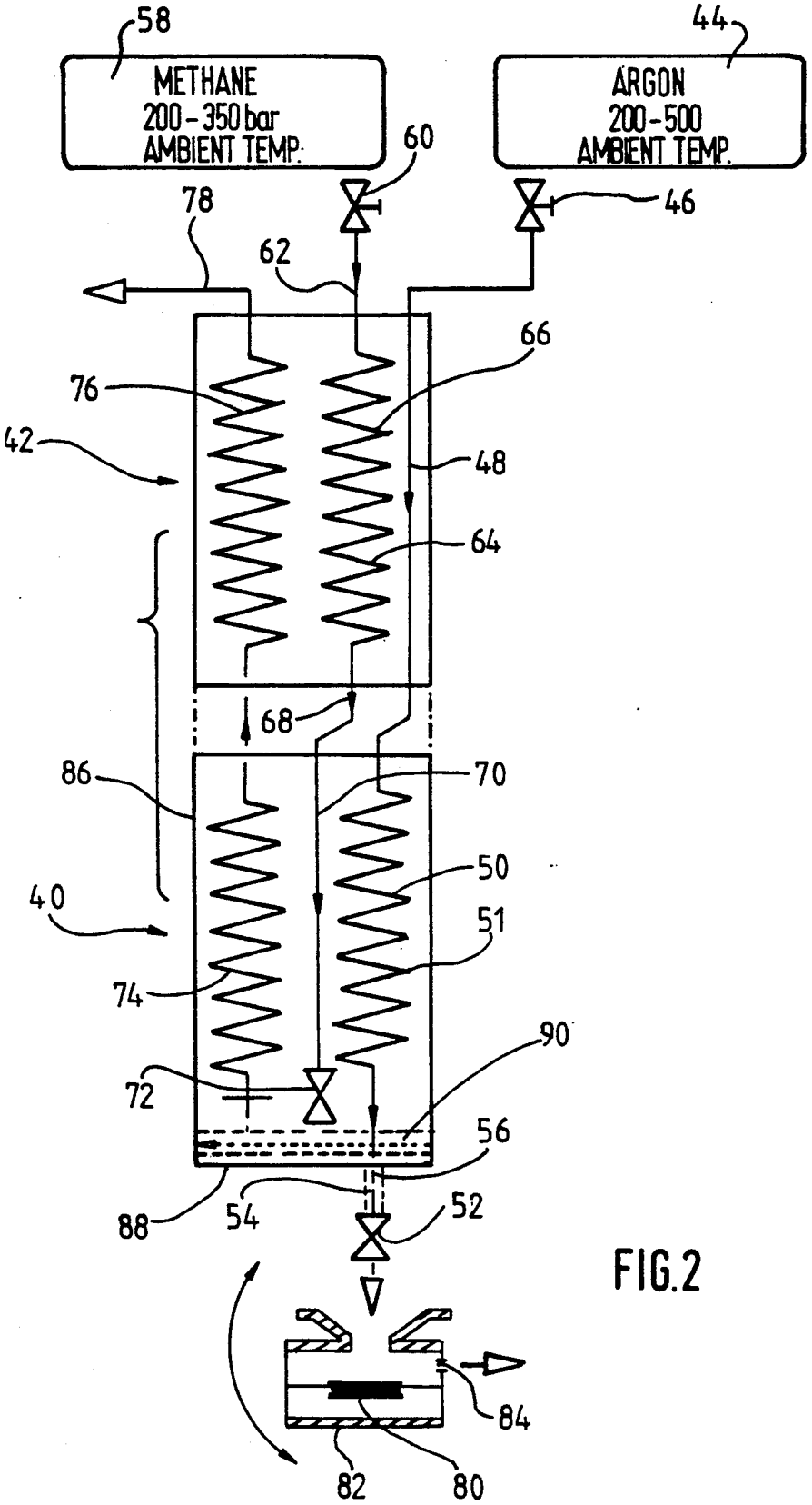
FIG. 2 is a schematic representation of an exemplary embodiment of the inventive cooling apparatus containing a second cooler solely for precooling the gas flowing through a Joule-Thomson cooler.

FIG. 2 illustrates a schematic sectional view of the inventive cooling apparatus containing two coolers, namely a first cooler 40 and a second cooler 42.

The first cooler 40 is operated using argon from a pressure container 44 containing pressurized argon In the pressurized gas container 44, the argon has ambient temperature and is under a pressure in the range of 200 to 500 bar. The argon is conducted via a valve 46 and a conduit or line 48 passing straight through the second cooler 42, to the forward or infeed flow path 50 of a heat exchanger 51 of the first cooler 40. The first cooler 40 constitutes an expansion cooler including a flow restrictor 52. The flow restrictor 52 is connected to an outlet of the forward or infeed flow path 50 through a high-pressure line or conduit 54. The high-pressure line or conduit 54 is provided with heat insulation 56.

The second cooler 42 is operated using methane from a pressure container 58 containing pressurized methane. In the pressure container 58, the methane also has ambient temperature and is under a pressure in the range of 200 to 350 bar. The methane is conducted through a valve to the inlet 62 of a forward or infeed flow path 64 of a countercurrent heat exchanger 66 of the second cooler 42. From an outlet 68 of the forward or infeed flow path 64 of the countercurrent heat exchanger 66 a line or conduit 70 runs straight through the first cooler 40 to a flow restrictor or nozzle 72. The flow restrictor 72 is placed at the first cooler 40 at an end which is remote from the second cooler 42 The high-pressure methane exits from the flow restrictor 72. As a result, the methane is expanded or depressurized and cooled.

The expanded or depressurized and cooled methane, then, flows through a return flow path 74 of the heat exchanger 51 of the first cooler 40 in countercurrent fashion with respect to the argon flowing through the forward or infeed flow path 50 of the first cooler 40. As a consequence, argon is precooled in the first cooler 40 under the action of the expanded or depressurized saturated methane vapor, however, not by the expanded or depressurized argon. The expanded and depressurized methane, then, flows through a return flow path 76 of the countercurrent heat exchanger 66 of the second cooler 42. Therein, the inflowing or infed high-pressure methane is precooled by means of the expanded or depressurized and cooled methane. The methane exits from the return flow path 76 through an outlet 78.

The argon issues from the flow restrictor 52 in the form of a jet and is directed to an infrared detector 80 disposed on a movable carrier 82 Thereafter, the argon effluxes through an aperture 84 in the carrier 82.

The first and second coolers 40 and 42 are encased by a highly heat insulating jacket or shell 86 which is closed on the side of the object to be cooled or infrared detector 80 by an end wall 88. The heat insulated high-pressure line or conduit 54 is passed through the end wall 88.

The mode of operation of the inventive cooling apparatus as described hereinbefore will now be explained with reference to FIG. 1.

Methane is cooled down to its boiling point by the Joule-Thomson process proceeding in the second cooler 42 and the flow restrictor 72. As already mentioned hereinabove, methane provides a substantially higher cooling power than argon. However, the temperature can not drop much below the boiling point of methane which is 118 K. Within the jacket or shell 86, there is formed liquid methane as indicated by the reference numeral 90. Due to the heat exchange with methane in the heat exchanger 51, the argon is precooled down to the boiling point of methane. Correspondingly, the state or condition of the argon changes along the constant pressure curve 32 until the state or condition marked "f" is reached. Upon expansion or depressurization at the flow restrictor 52 the state or condition of the argon further changes along the constant enthalpy curve 92 to the state or condition marked "g" on the straight line 34 associated with the saturated state or condition. Thus, a flow or set comprising a mixture of gaseous and liquid argon having a temperature of 87 K, i.e. the boiling point of argon, effluxes from the flow restrictor 52.

However, this argon, in contrast with the Joule-Thomson process, is not needed for precooling inflowing pressurized argon. The argon evaporates with the consequence that its state or condition changes to the right in the temperature-entropy diagram of FIG. 1 along the straight line 34 associated with the saturated state or condition until the state or condition marked "d'" is reached. Thereafter, the argon warms up. When the object to be cooled, i.e. the infrared detector 80 of the illustrated example, is cooled down to the boiling temperature or point of argon at 87 K, the argon, of course, no longer takes up or absorbs heat from the object to be cooled. The argon which is still very cold, can still be utilized for cooling the environment of the infrared detector 80 as well as the lines or conductors leading thereto in order to thereby reduce the heat supply to the infrared detector 80.

The cooling power of the argon in the inventive cooling apparatus is determined by the enthalpy difference of the states or conditions marked "g" and "d'". This difference is greater by a factor of 2.5 in comparison to the Joule-Thomson process described hereinbefore with reference to FIG. 1. The thus increased cooling power permits reducing the gas flows so that despite the additionally required methane flow the total amount of gas needed for achieving the desired extent of cooling is, in fact, lower than that required for a conventional Joule-Thomson cooler operating with the use of argon only. Also, the gases do not need to be placed under extremely high pressures for the cooling process carried out when employing the inventive cooling apparatus.

Instead of methane, tetrafluoromethane $CF_4$ may be used as the cooling gas Its boiling point is somewhat higher, namely 145 K as shown in FIG. 1.

Figure 3:
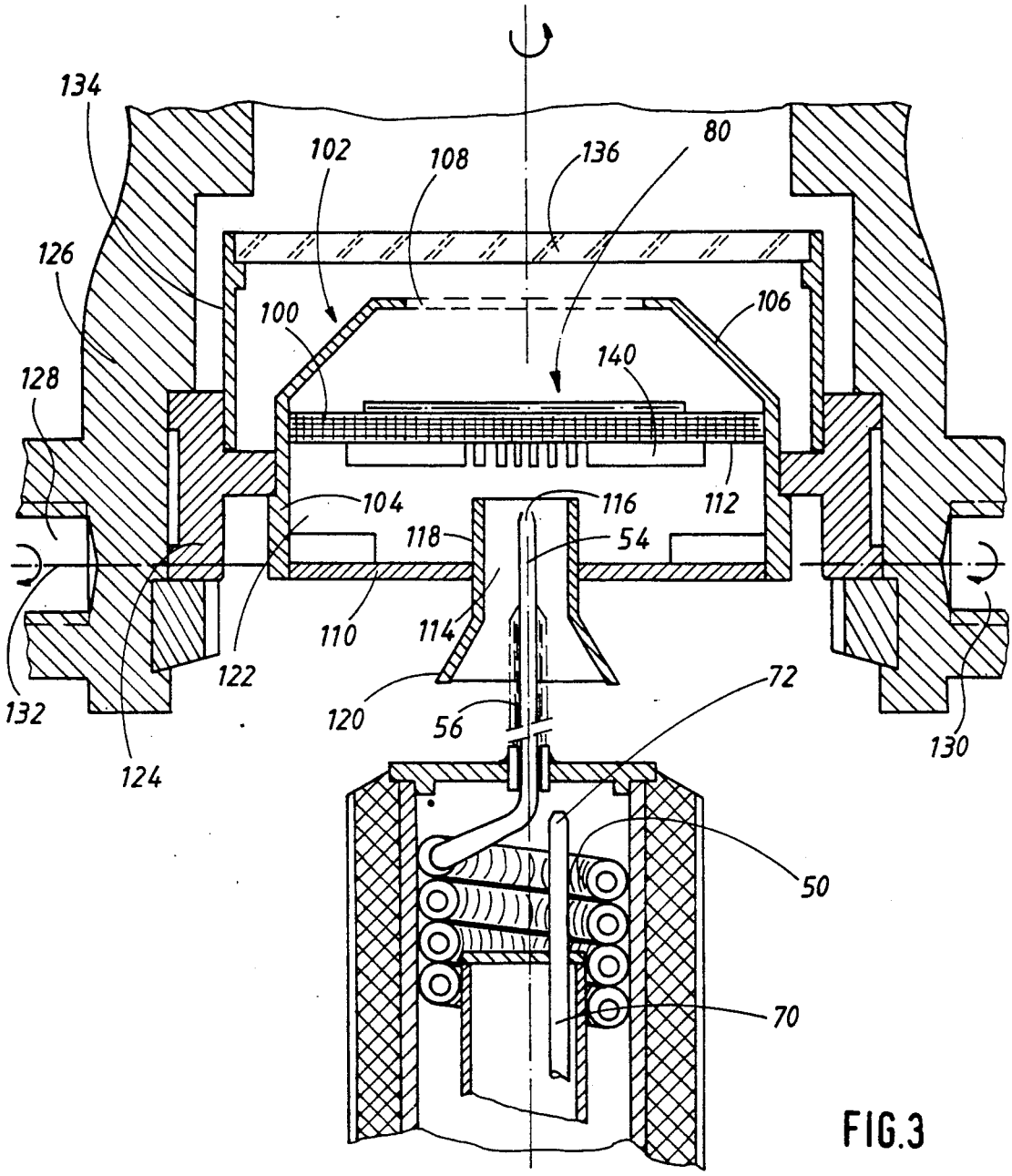
FIG. 3 is a longitudinal section showing an infrared detector as the object to be cooled, conjointly with an expansion or depressurization outlet of the cooling apparatus as shown in FIG. 2.

FIG. 3 shows in detail the arrangement for cooling the infrared detector 80 in the inventive cooling apparatus. This detector 80 is placed at a carrier or substrate 100. The carrier or substrate 100 is retained within a jacket or shell 102. The jacket or shell 102 comprises a substantially cylindrical section 104 and an adjoining section 106 in the form of a truncated cone. The section 106 defines a diaphragm opening 108 for a path of rays impinging upon the infrared detector 80. The carrier or substrate 100 is disposed in the transition region between the cylindrical section 104 and the truncated cone section 106. On the side remote from the carrier or substrate 100, a wall 110 is placed in the Jacket or shell 100 and extends approximately parallel to a carrier or substrate surface 112 on a side which is remote from the infrared detector 80. The wall 110 comprises a substantially central gap or aperture 114. The high-pressure line or conduit 54 including the flow restrictor 52 which, in the present instance, is designed as an expansion or depressurization opening 116 forming a nozzle, protrudes through the central gap or aperture 114. The high-pressure line or conduit 54 is surrounded by a collar 118 inserted into the gap or aperture 114. The collar 118 passes through the gap or aperture 114 and terminates in a funnel-shaped enlarged portion 120. A chamber 122 is defined or bounded by the surface 112 of the carrier or substrate 100, the cylindrical section 104 of the jacket or shell 102 and the wall 110. The high-pressure line or conduit 54 including the expansion or depressurization opening 116 protrudes into this chamber 122.

The jacket or shell 102 is held within a heat insulating ring 124. This ring 124 is placed within an inner frame or gimbal 126 of the seeker which is equipped with the infrared detector 80. The inner frame or gimbal 126 is mounted for pivotation about an axis 132 by means of pins 128 and 130. A substantially cylindrical socket 134 containing a filter 136 is seated at the ring 124.

Figure 4:
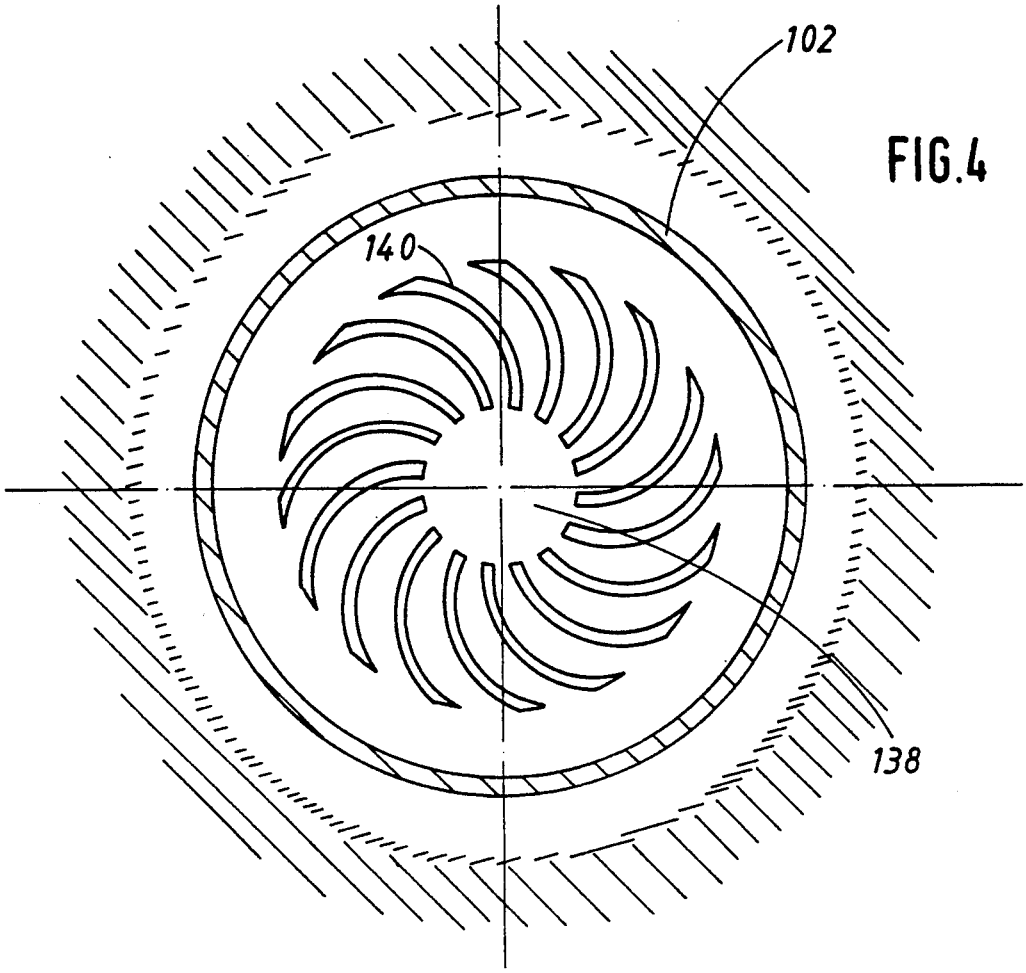
FIG. 4 is a section along the line A—A in FIG. 3.
Figure 5:
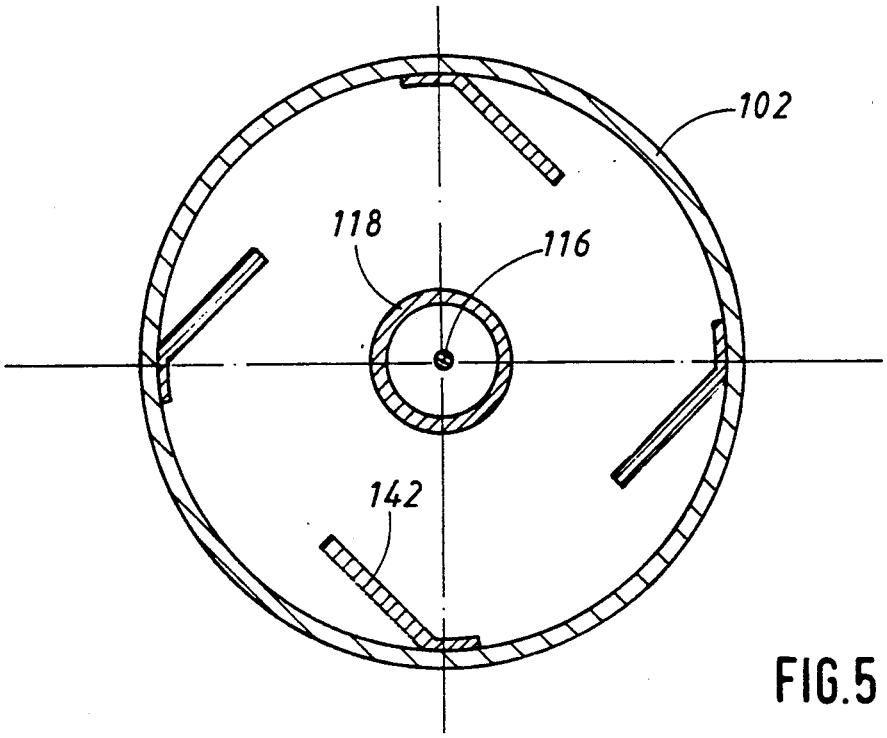
FIG. 5 is a section along the line B—B in FIG. 3.

As best seen in FIG. 4, the surface 112 of the carrier or substrate 100 defines a central, substantially flat or planar impingement area 138 which is located substantially opposite the expansion or depressurization opening 116 of the high-pressure line or conduit 54. The impingement area 138 is surrounded by a plurality of substantially spiral-shaped ribs or webs 140 which extend along a substantially spiral-shaped line. At the interior side of the wall 110 and the jacket or shell 102, there are provided a plural number of, in the illustrated example, four secantially extending guide plates or baffles 142 which are specifically shown in FIG. 5. The guide plates or baffles 142 extend only along a portion of the height of the cylindrical section 104 of the jacket or shell 102 as will be recognized in FIG. 3.

Figure 6:
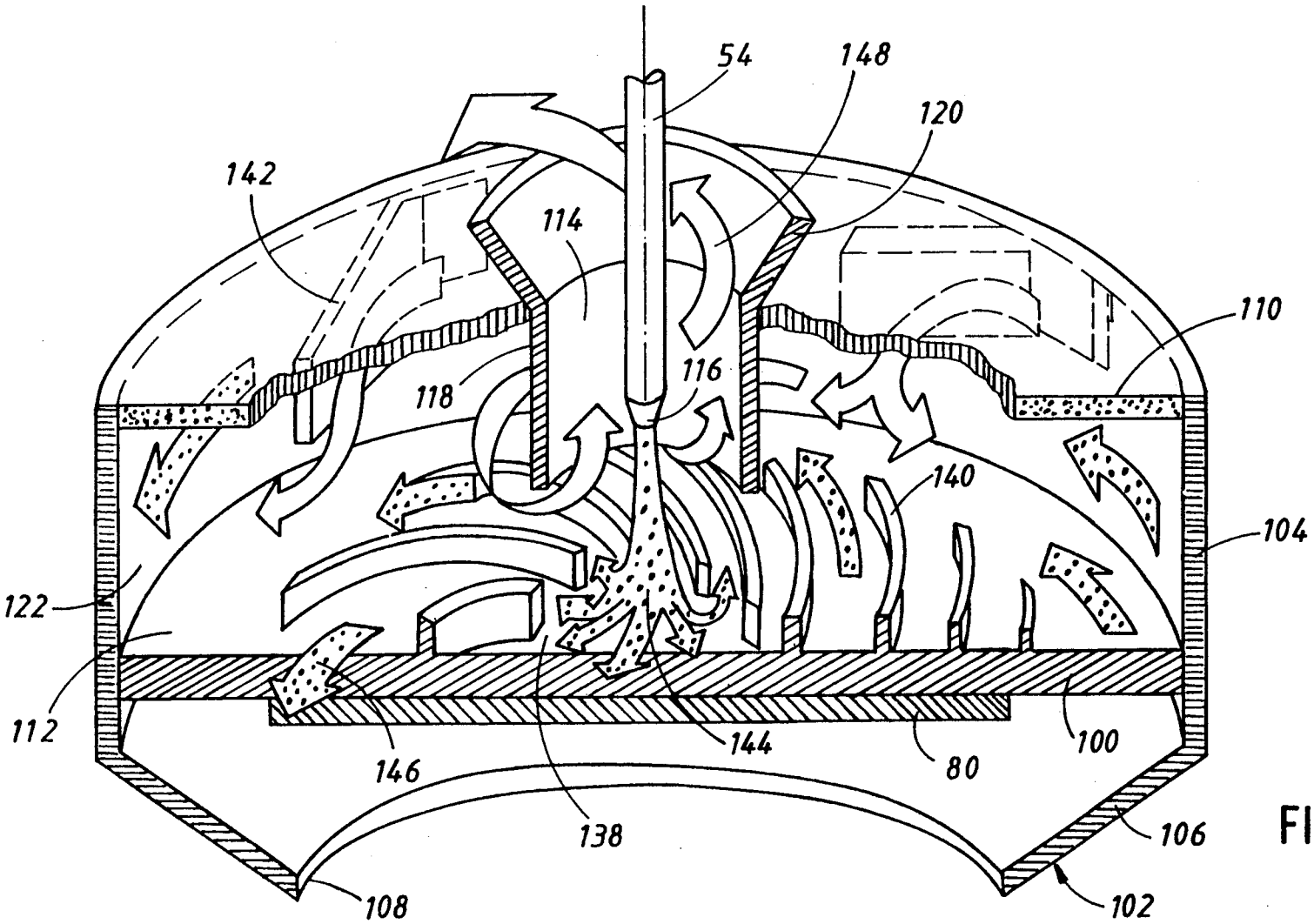
FIG. 6 is a broken-off perspective view showing the action of the seeker structure as illustrated in FIGS. 3 to 5 on the aerosol and gas flows.

The mode of operation of the hereinbefore described assembly in the inventive cooling apparatus can be best explained with reference to FIG. 6 of the drawings As described hereinbefore, a jet of saturated vapor, i.e. an aerosol containing gas and droplets of the coolant which is argon in the illustrated example, issues from the expansion or depressurization opening 116 of the high-pressure line or conduit 54. This is indicated in FIG. 6 by the jet 144. The jet 144 of saturated vapor impinges upon the impingement area 138 of the surface 112 at the carrier or substrate 100 and is radially outwardly deflected thereat. The deflected jet 144 of saturated vapor flows to the exterior in substantially spiral-shaped channels which are formed between the spiral-shaped ribs or webs 140. This is indicated in FIG. 6 by the arrows 146. As a result, a spin is imparted to the saturated vapor and a cyclone or vortex is thereby formed Consequently, the heavier droplets of the aerosol are collected at the jacket or shell 102 whereas the gas which is free of droplets, finally flows inwardly and out around the collar 118 and through the gap or aperture 114. This is indicated in FIG. 6 by the arrows 148.

Secondary vortices are produced by the guide plates or baffles 142 As a result, at least part of the gas is directed once again to the surface 112.

Due to the ribs or webs 140, the heat transfer is improved between the carrier or substrate 100 and the saturated vapor. As a result of the cyclone or vortex action, the droplets contained in the saturated vapor are separated and deposited so that they do not become entrained by the effluxing gas which is argon in the described example. Thus, the droplets accumulate within the chamber 122 and evaporate therein. This effect is assisted by the presence of the collar 118. The heat of evaporation is withdrawn from the carrier or substrate 100 and the jacket or shell 102. The truncated cone section 106 of the jacket or shell 102 thereby constitutes a cooled diaphragm including the diaphragm aperture 108 for the path of rays directed to the infrared detector 80. This cooled diaphragm shields the infrared detector 80 from heat radiation originating from the warm environment. The guide plates or baffles 142 finally provide for the gas to be passed once again across the surface 112 of the carrier or substrate 100 prior to exiting through the gap or aperture 114.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A cooling apparatus for cooling an object to be cooled, comprising:

primary cooling means arranged to receive a first pressurized gaseous coolant having an inversion temperature, said cooling means comprising a high-pressure conduit having an end which defines an expansion outlet for expanding said pressurized gaseous coolant and for forming a jet of said coolant;

an additional Joule-Thomson cooler as precooling means arranged to receive a second pressurized gaseous coolant and comprising expansion outlet means for expanding said second pressurized gaseous coolant and counter-current heat exchanger means for cooling said second pressurized gaseous coolant by said expanded second pressurized coolant;

and additional heat exchanger means for precooling said first pressurized gaseous coolant by said expanded second pressurized coolant to a temperature below said inversion temperature, whereby said first coolant, when emerging as said jet from said expansion outlet means, is cooled further and forms an aerosol composed of coolant droplets and a gaseous coolant component;

mounting means for pivotally mounting said object to be cooled relative to said primary cooling means;

said object to be cooled defining a cavity with a first internal, substantially planar surface and a second internal surface opposite said first internal surface and spaced therefrom, said second internal surface defining a central aperture therethrough, said first internal surface including an impingement area opposite said aperture, said first and second internal surfaces being connected by a circumferential jacket;

said high-pressure conduit extending into said cavity through said aperture and being arranged to direct said jet onto said impingement area;

said object to be cooled having a collar around said aperture and coaxial with said high-pressure conduit, said collar and said high-pressure conduit permitting said pivotal movement and forming a gas exit therebetween;

a plurality of spiral shaped ribs projecting into said cavity from said first surface around said impingement area and extending outwardly from said impingement area, thereby defining spiral channels therebetween, which are axially open towards said cavity; and whereby said aerosol is radially outwardly deflected by said internal surface and guided by said spiral channels, a spin being imparted to said aerosol to form a cyclone within said cavity, said droplets of said aerosol being deposited on said jacket and only said gaseous coolant component of said aerosol flowing inward and emerging from said cavity through said central aperture.

2. A cooling apparatus as claimed in claim 1, wherein said high-pressure conduit is surrounded by a heat-insulating shell.

3. The cooling apparatus as defined in claim 1, further including:

a wall defining said chamber conjointly with said jacket;

said surface of said object to be cooled constituting a substantially planar surface;

said wall containing said opening defined by said chamber; and said wall extending substantially parallel to said surface of said object to be cooled.

4. The cooling apparatus as defined in claim 3, further including:

guide plates provided at said wall and extending from said wall and said jacket into the interior of said chamber defined by said wall conjointly with said jacket;

said guide plates being secantially disposed at said wall;

said surface of said object to be cooled and said wall being arranged at a predetermined spacing; and said guide plates extending through a predetermined portion of said spacing.

5. The cooling apparatus as defined in claim 1, wherein said object to be cooled includes a substrate supporting a detector; and said surface of said object to be cooled constituting a surface of the substrate on a side remote from the detector.

6. The cooling apparatus as defined in claim 5, wherein:

said detector constitutes an optical detector;

said jacket being attached to said substrate and also extending on the side of the optical detector and protruding beyond said optical detector; and said jacket defining a cooled diaphragm associated with said optical detector.

7. The cooling apparatus as defined in claim 6, further including:

a seeker containing said optical detector;

said optical detector constituting an infrared detector;

said seeker defining a path of rays; and said jacket constituting a cooled diaphragm associated with said path of rays of said seeker.

8. The cooling apparatus as defined in claim 6, wherein said optical detector is an infrared detector.

9. The cooling apparatus as defined in claim 1, further including pivoting means for pivoting said object to be cooled relative to said expansion outlet.

* * * * *